United States Patent [19]

Imhoff

[11] 4,445,717

[45] May 1, 1984

[54] FLUSH BOLT

[75] Inventor: William B. Imhoff, Springdale, Conn.

[73] Assignee: Leigh Products, Inc., Grand Rapids, Mich.

[21] Appl. No.: 264,358

[22] Filed: May 18, 1981

[51] Int. Cl.[3] ..... E05C 1/02

[52] U.S. Cl. ..... 292/177; 49/2; 292/DIG. 62; 292/DIG. 66

[58] Field of Search ..... 292/DIG. 62, 177, 178, 292/179, 180, 181, 182, DIG. 21, DIG. 65, DIG. 66, 333, 34–36, 139, DIG. 44; 49/1, 2

[56] References Cited

U.S. PATENT DOCUMENTS

| | | | |
|---|---|---|---|
| 1,158,412 | 10/1915 | Wheary | 292/DIG. 62 X |
| 1,174,652 | 3/1916 | Banks | 292/34 X |
| 2,202,916 | 6/1940 | Mussa | 292/177 |
| 2,264,182 | 11/1941 | Miller | 292/181 X |
| 2,529,340 | 11/1950 | Jarrett | 292/182 |
| 2,804,159 | 8/1957 | Gavito | 292/177 X |
| 3,578,369 | 5/1971 | Coopersmith | 292/66 X |
| 3,582,122 | 6/1971 | Foster et al. | 292/DIG. 21 X |
| 3,811,717 | 5/1974 | Floyd et al. | 292/92 |
| 4,005,886 | 2/1977 | Likette | 292/177 |
| 4,099,753 | 7/1978 | Gwozdz et al. | 292/177 |
| 4,200,954 | 5/1980 | McCabe | 49/2 X |

*Primary Examiner*—Thomas J. Holko
*Assistant Examiner*—R. Illich
*Attorney, Agent, or Firm*—Costas, Montgomery & Dorman

[57] ABSTRACT

A flush bolt mechanism adapted to be mounted at the vertical edge of the inactive door of a pair of hinged doors. Means are provided to prevent damage to the mechanism due to misalignment of the bolt and the strike plate. All translational motion of the mechanism substantially takes place along a single axis except for the motion of activation.

6 Claims, 6 Drawing Figures

FLUSH BOLT

BACKGROUND OF THE INVENTION

This invention relates to an automatic flush bolt mechanism for latching the inactive door of a pair of swinging doors.

Flush bolts are commonly used in pairs to latch the inactive door at the top and bottom thereof. The bolts of these mechanisms, when retracted, are flush or substantially flush with the respective upper and lower edges of the inactive door. When the bolts are projected, the bottom bolt engages with a strike plate located in the door sill or floor, while the top bolt engages with a strike plate located in the door frame above the door. Such door and flush bolt installation are shown in FIG. 12 of U.S. Pat. No. 3,578,369.

When the inactive door is in the closed position, the closing of the active door depresses the triggers of these mechanisms and thereby causes the bolts to project into their respective strike plates thereby securing the inactive door in a locked position. When the active door is opened, the bolts retract out of their respective strike plates and the inactive door is free to open.

A number of flush bolt mechanisms adapted to be mounted and employed on one of a pair of hinged doors have exhibited in various forms one or more characteristics which are desirable of such a bolt mechanism and which are incoporated into the present invention. Among such characteristics, the bolt mechanism should be capable of heavy-duty use and should be relatively easy to assemble and install. The bolt mechanism should provide a mechanism which will prevent the bolt mechanism from being damaged if the bolt and strike plate are not in alignment when the bolt mechanism is activated. It is also desirable to provide means for preventing the retraction of the bolt when the bolt mechanism is subject to heat in case of fire. Naturally, the bolt mechanism should provide for efficient activation of the mechanism and efficient projection and retraction of the bolt.

Automatic flush bolts are well known in the art. An example is shown in U.S. Pat. No. 3,578,369, assigned to the assignee of this application, in which the bolt is driven by rotation of a shaft activated by a pivotally mounted cam gear. Additionally, other flush bolts such as shown in U.S. Pat. No. 4,005,886 are operated by the presence of a second drive shaft which is operated by a pivotally mounted cam. This second drive shaft imparts sliding motion to the first shaft through a spring and thereby projects the bolt. In U.S. Pat. No. 4,099,753, provision is made for such occurrences by the use of a floating toggle which permits a pivot pin for the toggle arm to move and prevent extension of the bolt if there is misalignment. This tends to complicate an otherwise simple mechanism and results in lack of a direct drive.

In the present invention, a direct toggle drive for a flush bolt is provided, together with an intermediate connection between the drive mechanism and the bolt mechanism, which is relatively stiff in a direct drive mode but which is resilient and protects the bolt assembly in the event of misalignment of the extensible bolt with the strike plate.

The present invention represents an advancement over prior bolt mechanisms by virtue of a less complex and highly efficient override structure to prevent damage from misalignment and by virtue of the efficient translational motion of the bolt mechanism. Moreover, the present invention provides a bolt mechanism which is relatively easy to assemble, and by virtue of its unique construction and operation, provides a bolt mechanism which is adaptable for heavy-duty use.

SUMMARY OF THE INVENTION

The present invention comprises a drive assembly which is responsive to a slidably mounted trigger. A bolt assembly receives the drive assembly. An override means which is positioned between the drive and bolt assemblies, act to prevent damage to the bolt mechanism if the bolt misaligns with the strike plate and encounters external resistance to projection of the bolt. Except for the trigger and an actuating toggle, the moving components of the bolt mechanism are positioned on the vertical axis. Consequently, the translational motion of the bolt mechanism essentially occurs along a single vertical axis with the exception of the motion of the trigger which moves substantially orthogonal to the vertical axis of motion.

An object of this invention is to provide a new and improved bolt mechanism suitable for use in projecting bolts from the top and bottom edges of the inactive door of a pair of swinging doors.

Another object of this invention is to provide a flush bolt mechanism of a new and improved simplified direct drive design.

A further object of this invention is to provide a flush bolt mechanism having new and improved drive means to prevent damage to the mechanism due to misalignment of the bolt with a strike plate.

The features of the invention which are believed to be novel are particularly pointed out and distinctly claimed in the concluding portion of this application. The invention, however, both as to its operation and organization, together with further objects and advantages thereof, may best be appreciated by reference to the following detailed description in conjunction with the drawings.

DETAILED DESCRIPTION

Figure 1:
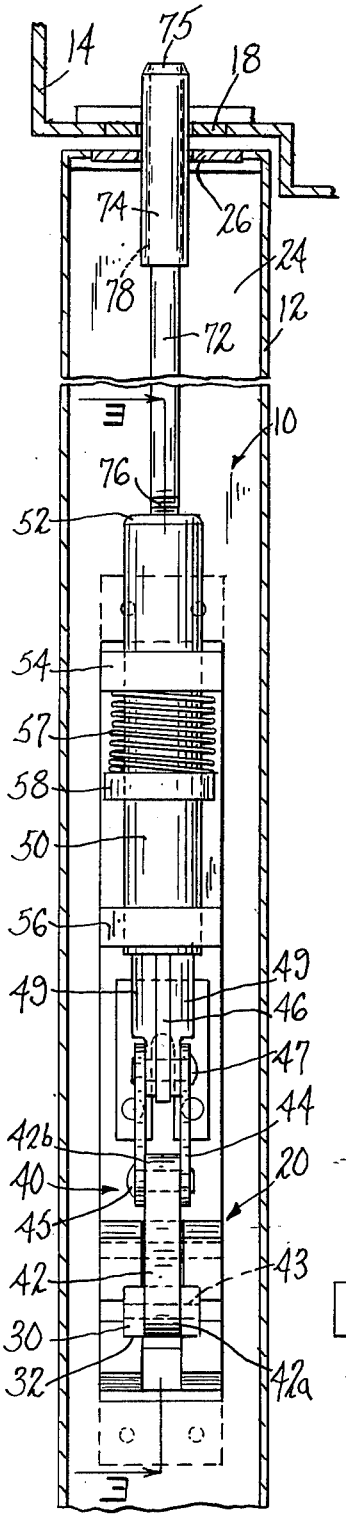
FIG. 1 is a rear elevational view of a bolt mechanism embodying the invention showing the bolt mechanism in relation to a door and door frame, the mechanism being shown in a projected position.
Figure 2:
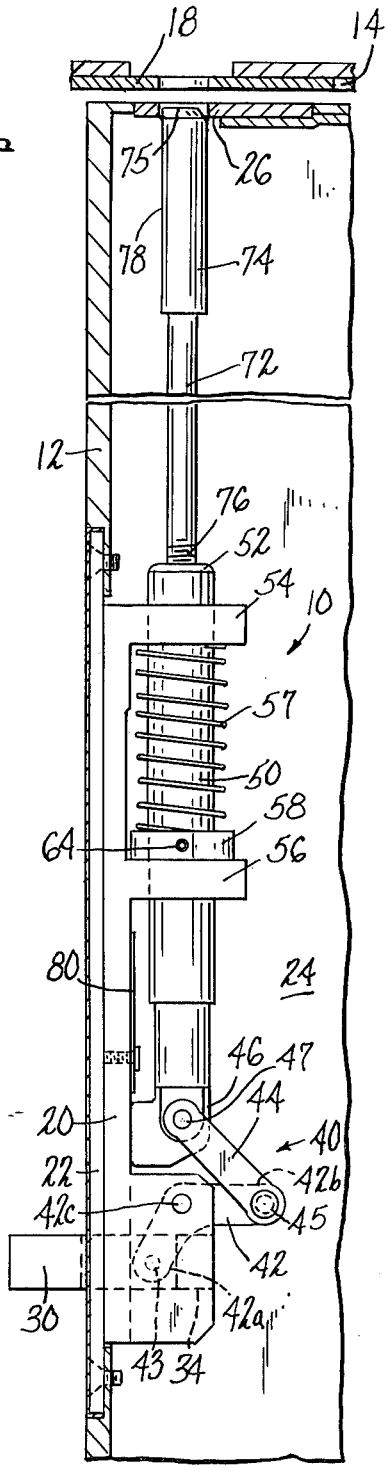
FIG. 2 is a side elevational view of the bolt mechanism of FIG. 1 showing the mechanism in a retracted position.
Figure 3:
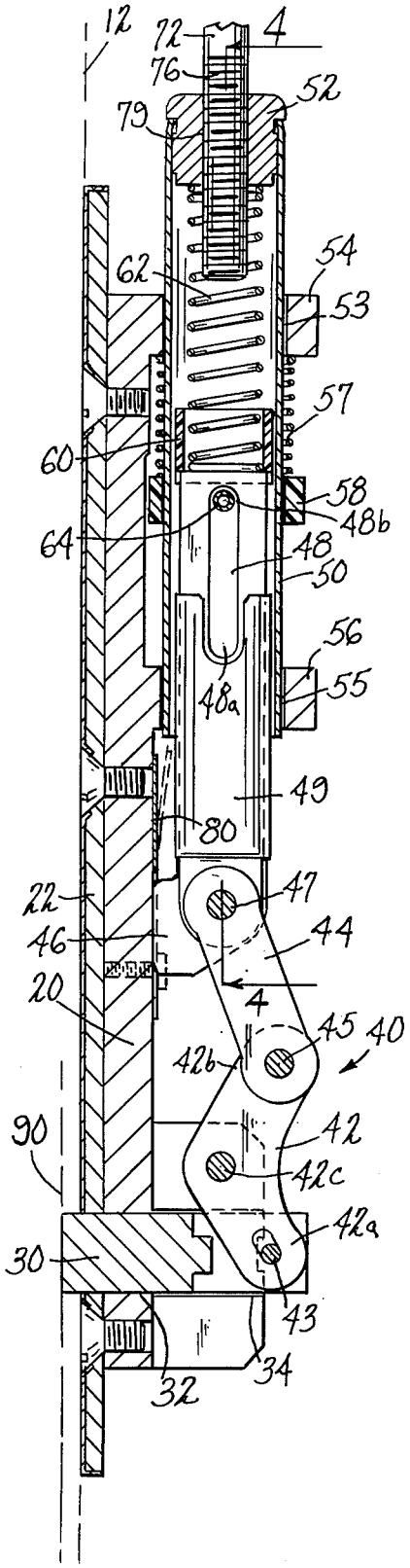
FIG. 3 is a fragmentary sectional view taken on the line 3—3 of FIG. 1.

With reference to FIGS. 1 thru 3, a flush bolt mechanism shown generally as 10 is mounted at the vertical edge of door 12. When door 12 is in a closed position, door 12 and bolt mechanism 10 align with door frame 14 substantially as shown in FIGS. 1 and 2. Door frame 14 is provided with a strike plate 18 structured to receive a bolt as described below.

Bolt mechanism 10 comprises a housing 20 which upon being mounted as shown in FIG. 1, extends in a general vertical direction and acts to receive elements of the bolt mechanism and to function as a support structure as well as to provide structure for mounting the bolt mechanism on the door. Housing 20 is further structured and adapted so that in combination with plate 22, the bolt mechanism 10 may be mounted flush with the vertical edge of the door as illustrated in FIGS. 2 and 3. The bolt mechanism 10 is accommodated in a recess 24 opening through the vertical edge proximate the horizontal edge of the door. A guide 26 mounted in the horizontal edge of the door in alignment with strike plate 18 when door 12 is closed, provides an opening from which a bolt may be projected as described below. It should be noted that bolt mechanism 10 may be employed to project a bolt at either the top or the bottom of a door. For purposes of illustration only, the description will be directed primarily to a bolt mechanism mounted to project a bolt at the top of a door.

With reference to FIG. 3, a trigger 30 is slidably received in a channell 32 which extends horizontally through the housing 20. In preferred form, trigger 30 is dimensioned to extend substantially the width of housing 20 and to further protrude in a horizontal direction outwardly from the housing.

A drive assembly 440 responsive to the position of trigger 30 comprises a drive link 42 connected to a link 44 which connects to a a drive member in the form of drive bar 46. Drive link 42 is preferably in the form of a bell crank having a lower end 42*a* and an upper end 42*b* and is pivotally mounted intermediate the end to housing 20 about a fixed pivot 42*c*. A pin 43 connects the lower end 42*a* to trigger 30, the lower end 42*a* being received in a recess 34 at the rear of trigger 30. Pins 45 and 47 at opposite ends of link 44 connect link 44 to upper end 42*b* of link 42 and the lower end of drive bar 46, respectively.

The upper end of drive bar 46 is guidably and slidably received in a tube 50. A pair of spacers 49 of substantially hemispherical cross-section and of nylon or low friction plastic material may be employed at opposing sides of drive bar 46 to facilitate the reception of tube 50 and to minimize friction between drive bar 46 and tube 50 when and if they slide relative to each other as described below. Tube 50 is an elongated structure which is open at the end receiving the drive bar and spacers and substantially closed at the opposite end. Tube 50 may be of a unitary structure or may receive a tube insert 52 at the opposite end. Tube 50 is slidably received in aligned cylindrical openings 53 and 55 of an upper bearing 54 and a lower bearing 56, respectively, which extend horizontally from housing 20. Openings 53 and 55 and tube 50 are of substantially uniform and commensurate diameters so that tube 50 may slide smoothly in a vertical direction in openings 53 and 55.

A helical spring 57 disposed around the exterior of tube 50 is positioned between upper bearing 54 and a spring seat 58 on tube 50. Seat 58 may be an annular member rigidly fixed to tube 50 between bearings 54 and 56. Spring 57 urges stop 58 away from upper bearing 54 and hence biases tube 50 in a direction toward lower bearing 56 in an unlatched condition. Lower bearing 56 defines the limit of the movement of seat 58 and tube 50 under the bias of spring 57.

Figure 4:
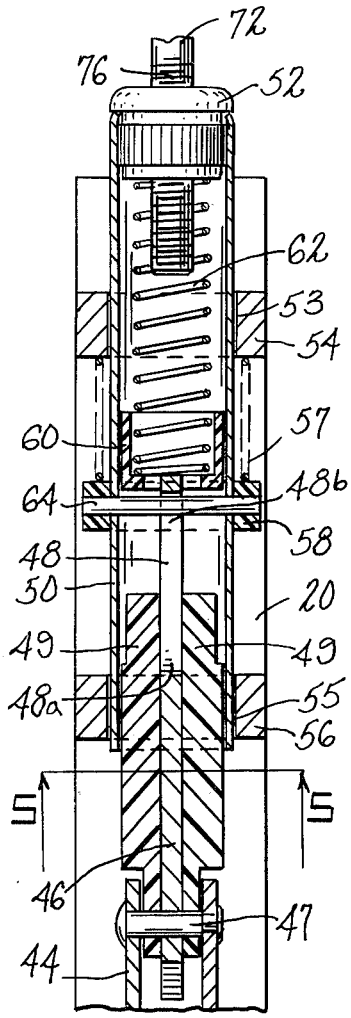
FIG. 4 is a fragmentary sectional view taken on the line 4—4 of FIG. 3.
Figure 5:
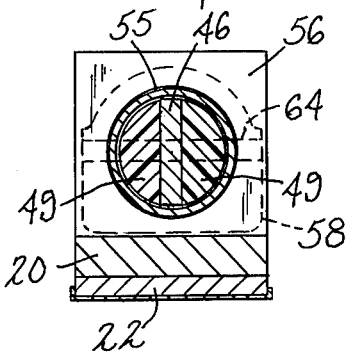
FIG. 5 is a sectional view taken along the line 5—5 of FIG. 4.
Figure 6:
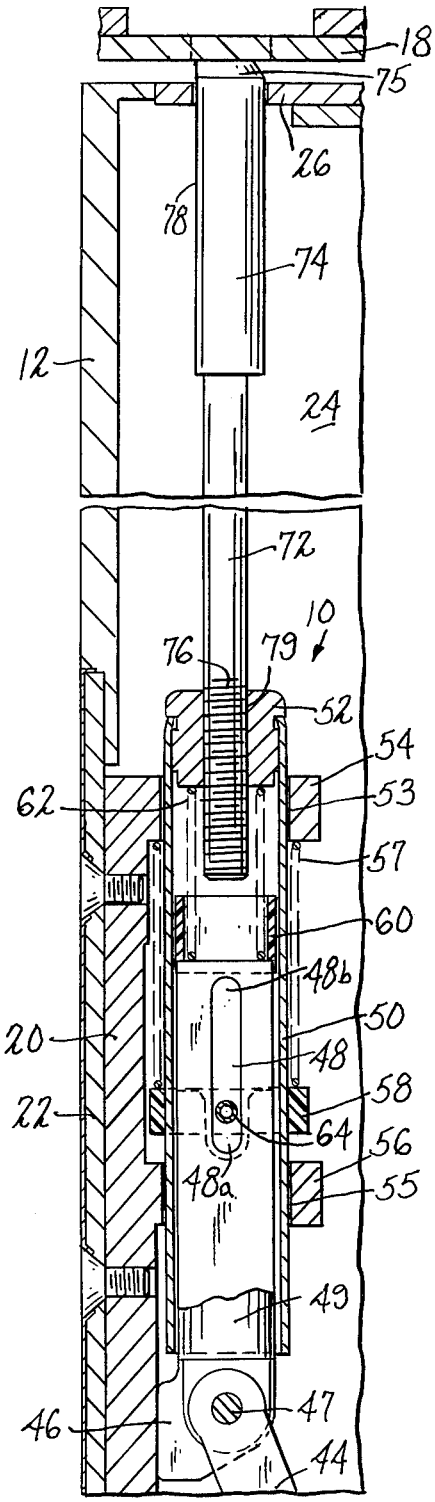
FIG. 6 is a fragmentary side sectional view of the bolt mechanism showing the bolt mechanism in an override position.

With further reference to FIG. 3 and FIG. 4, drive bar 46 engages against the bottom of spring 62 which is positioned within cup 60 and within tube 50. The opposite end of spring 62 bears against tube insert 52. Spring 62 is biased to resist the movement of drive bar 46, toward tube insert 52. Spring 62 is selected to be relatively stiff and in essence provides a solid connection between drive bar 46 and tube 50 unless there is misalignment between the bolt and the keeper. Drive bar 46 is provided with a central channel 48 having ends 48*a* and 48*b* which, in cooperation with a pin 64 extending from opposite sides of tube 50 into channel 48, define the distance differential between the end of drive bar 46 and tube insert 52. The latter distance differential which is approximately equal to the distance between ends 48*a* and 48*b* is approximately equal to the distance that the bolt is projected above the horizontal edge of the door as described below. The bolt mechanism at the positions of maximum and approximately minimum distance between drive bar 46 and tube insert 52 are illustrated in FIGS. 3 and 6, respectively. Pin 64 also functions to fasten stop 58 to slide tube 50.

A rod 72 extends vertically from tube insert 52. A bolt 74 is mounted at the opposite end of rod 72. Bolt 74 is adapted to be received in strike plate 18 of the door frame 14 and consequently, lock door 12 in closed position. Means may be provided to adjust the distance between bolt 74 and insert 52. One form of such means as illustrated in FIGS. 4 and 6, may comprise male threads 76 at the end of rod 72 which mate with female threads 79 of insert 52 so that the depth of reception of rod 72 in insert 52 may be rotatably varied. Bolt 74 may be provided with a flat 78 vertically traversing one side of bolt 74. Guide 26 may be shaped to conform to the bolt cross-section defined partially by flat 78 so that after the desired distance adjustment is obtained, further rotation of rod 72 is prevented.

In operation, the bolt mechanism 10 is mounted flush at the vertical edge of door 12. The position of the extreme end 75 of bolt 74 is adjusted so that the bolt is substantially flush with the horizontal edge of the door and does not project from the guide 26, when the trigger is in an extended non-activated position as illustrated in FIG. 2. Spring 57 biases the bolt mechanism to a retracted position as illustrated in FIG. 2, in the absence of a vertical force exerted against the protruding portion of trigger 30 of sufficient force to overcome the spring bias.

The preferred environment of the invention is in conjunction with a pair of controlled swinging doors. When both doors are closed, a wear plate mounted on the vertical edge of the active door forces the trigger 30 into the housing to the position as shown in FIG. 3. Drive link 42 which is activated by trigger 30, forces link 44 to propel drive bar 46 in a vertical direction. Drive bar 46 exerts a force against spring 62, which force is ultimately vertically transferred to bolt 74, thus acting to project bolt 74 out of the horizontal guide 26 at the top of door 12. If bolt 74 and strike plate 18 are substantially aligned, then bolt 74 will be received in strike plate 18 as illustrated in FIG. 1, thus locking the door. In this condition, there is no compression of spring 62.

If strike plate 18 and bolt 74 are not in alignment as illustrated in FIG. 6 and bolt 74 encounters sufficient resistance to overcome the threshold bias of spring 62, the vertical drive force of drive bar 46 will be partially expended by compression of spring 62. The distance between the upper end of drive bar 46 and tube insert 52 will be reduced to accommodate the external resistance to projection of bolt 74 as shown in FIG. 6. This latter override assembly will thus prevent the bolt mechanism from being internally damaged due to misalignment. If at a subsequent time, alignment occurs, the bolt will be vertically projected into the door frame strike plate.

The force required to overcome the bias of spring 62 should be greater than the force required to overcome the bias of spring 57. Spring 62 essentially provides a direct but differential drive engagement between the bolt assembly and the drive assembly, whereby for a drive force below a given threshold value, the vertical drive motion of drive bar 46 is essentially entirely transferred through spring 62 to project bolt 74. However, if bolt 74 encounters a sufficient resistance, then the drive force of drive bar 46 is at least partially expended by compression of spring 62.

The translational motion of the bolt mechanism including the motion of the override assembly essentially occurs along a single vertical axis except for the activating motion of the trigger 30 which acts substantially orthogonally to the previously described vertical axis of motion.

Safety means may also be provided to prevent the bolt from accidentally retracting if the bolt mechanism is subject to heat from fire. One form of the safety means comprises a bi-metallic strip 80 positioned beyond the lower end of tube 50. Strip 80 is structured so that in case of sufficient heat, strip 80 will move to the position as shown in the dotted lines of FIG. 3 and will thus prevent the tube 50 from vertically extending past the end of the metallic strip to a retracted position.

It may thus be seen that the objects of the invention set forth as well as those made apparent from the foregoing description are efficiently obtained. While preferred embodiments of the invention have been set forth for purposes of disclosure, modifications of the disclosed embodiments of the invention as well as other embodiments thereof may occur to those skilled in the art. Accordingly, the appended claims are intended to cover all embodiments of the invention which do not depart from the spirit and scope of the invention.

What I claim is:

1. A flush bolt mechanism for use in conjunction with a pair of doors having free adjacent vertical edges when closed, said mechanism adapted to be mounted on one door substantially flush with the vertical edge thereof and to project a bolt from a horizontal edge of said door, said mechanism comprising:

a housing, said housing defining first and second vertically spaced apart guide means, a bolt assembly comprising a tubular member received in said guide means for vertical movement between a retracted position and an extended position, a bolt extending from said tubular member, a trigger member slidably received in said housing and movable substantially perpendicular to said tubular member, a drive member within said tubular member, a first spring disposed within said tubular member between said bolt and said drive member and acting to transmit movement of said drive member to said tubular member, a drive linkage directly connecting said trigger member to said drive member whereby movement of said trigger member inwardly of said housing extends said bolt assembly, said drive linkage comprising a first link having first and second ends and pivotally connected to said trigger at a first end thereof and pivotally connected to said housing intermediate the ends thereof, a second link connected at one end thereof to said drive member and connected at the other end thereof to said second end of said first link, and a second spring disposed about said tubular member acting on one of said guide means and biasing said bolt assembly towards a retracted position.

2. The mechanism of claim 1 wherein the second spring acting against one of said guide means and a stop rigidly positioned on said tubular member, said stop being movably restricted between said bearings.

3. The mechanism of claim 1 wherein said tubular member has a closed end and said first spring is positioned in said tubular member between said drive member and said closed end and acting to maintain an override distance between the end of the drive member and said closed end.

4. The mechanism of 1 wherein the force required to overcome the bias of said second spring is less than the force required to overcome the spring force acting to maintain the override distance.

5. The mechanism of claim 1 further comprising thermal means to prevent retraction of said bolt assembly due to heat from fire.

6. The mechanism of claim 5 wherein said thermal means is a bi-metallic strip which when sufficiently heated, engages an end of the bolt assembly.

* * * * *